US008915612B2

(12) United States Patent
Kurt et al.

(10) Patent No.: US 8,915,612 B2
(45) Date of Patent: Dec. 23, 2014

(54) ILLUMINATION SYSTEM FOR SPOT ILLUMINATION WITH REDUCED SYMMETRY

(75) Inventors: Ralph Kurt, Eindhoven (DE); Teunis Willem Tukker, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 235 days.

(21) Appl. No.: 13/378,718

(22) PCT Filed: Jun. 11, 2010

(86) PCT No.: PCT/IB2010/052611

§ 371 (c)(1),
(2), (4) Date: Dec. 16, 2011

(87) PCT Pub. No.: WO2010/146512

PCT Pub. Date: Dec. 23, 2010

(65) Prior Publication Data

US 2012/0092864 A1 Apr. 19, 2012

(30) Foreign Application Priority Data

Jun. 16, 2009 (EP) ..... 09162852
Apr. 16, 2010 (EP) ..... 10160163

(51) Int. Cl.

| | |
|---|---|
| ***F21V 13/04*** | (2006.01) |
| ***F21V 7/04*** | (2006.01) |
| ***F21K 99/00*** | (2010.01) |
| *F21Y 101/02* | (2006.01) |

(52) U.S. Cl.

CPC ..... *F21K 9/00* (2013.01); *F21Y 2101/02* (2013.01)

USPC ..... 362/243; 362/341; 362/348; 362/231

(58) Field of Classification Search

USPC ..... 362/243, 296.01, 341, 346, 348
See application file for complete search history.

(56) References Cited

U.S. PATENT DOCUMENTS

| | | | | |
|---|---|---|---|---|
| 5,758,951 | A * | 6/1998 | Haitz | 362/259 |
| 6,200,002 | B1 * | 3/2001 | Marshall et al. | 362/231 |
| 6,614,126 | B1 * | 9/2003 | Mitchell | 307/9.1 |
| 6,982,518 | B2 * | 1/2006 | Chou et al. | 313/46 |

(Continued)

FOREIGN PATENT DOCUMENTS

| | | | |
|---|---|---|---|
| DE | 202008013660 | U1 | 12/2008 |
| EP | 1693615 | A1 * | 8/2006 |

(Continued)

*Primary Examiner* — Peggy Neils

(57) ABSTRACT

An illumination system (1;30;40;60;70;90) for spot illumination comprising: a tubular reflector (3;31;61;91) with a reflective inner surface, the tubular reflector having an entrance aperture (9), and an exit aperture (10) being larger than the entrance aperture; and a light-source array (2;33;41;63;71;93) comprising a plurality of light-sources arranged in a physical light-source configuration to emit light into the tubular reflector at the entrance aperture thereof. The tubular reflector (3;31;61;91) comprises a plurality of reflective surfaces (14*a-g*) each being arranged to provide a primary mirror image of the light-source array, the primary mirror image having a primary mirror image light-source configuration; and the light-source array (2;33;41;63;71;93) is configured in such a way that, for each of the primary mirror image, at least half of all secondary mirror images of the light-source array resulting from reflection of the primary mirror image by the reflective surfaces (14*a-g*) exhibit secondary mirror image light-source configurations that are different from the physical light-source configuration.

14 Claims, 5 Drawing Sheets

(56) References Cited

U.S. PATENT DOCUMENTS

| | | | | |
|---|---|---|---|---|
| 7,403,680 | B2 * | 7/2008 | Simbal | 385/31 |
| 7,483,220 | B2 * | 1/2009 | Kittelmann et al. | 359/742 |
| 7,591,570 | B2 * | 9/2009 | Holder et al. | 362/341 |
| 7,866,845 | B2 * | 1/2011 | Man | 362/247 |
| 8,529,103 | B2 * | 9/2013 | Tukker et al. | 362/307 |
| 2002/0080622 | A1 * | 6/2002 | Pashley et al. | 362/555 |
| 2006/0008237 | A1 | 1/2006 | Imade | |
| 2007/0103894 | A1 | 5/2007 | Klose | |
| 2007/0291491 | A1 * | 12/2007 | Li et al. | 362/307 |

FOREIGN PATENT DOCUMENTS

| | | | |
|---|---|---|---|
| JP | 5048102 | U | 6/1993 |
| WO | 0058664 | A1 | 10/2000 |
| WO | 2006105646 | A1 | 10/2006 |
| WO | WO 2006105646 | A1 * | 10/2006 |

* cited by examiner

ILLUMINATION SYSTEM FOR SPOT ILLUMINATION WITH REDUCED SYMMETRY

TECHNICAL FIELD

The present invention relates to an illumination system for spot illumination, comprising a tubular reflector and a light source array.

BACKGROUND OF THE INVENTION

In spot illumination applications, such as scene setting or other atmosphere creating lighting, white light sources with colored filters have been used to a great extent. Lately, as an alternative, illumination systems with colored light sources, such as light emitting diodes, LEDs, have been developed. In systems with colored light sources, the color can be changed by electronic control, and all accessible colors are always available.

In spot illumination applications, the homogeneity of the emitted light is of great importance, regardless of whether the spot illumination system is color controllable or not.

One example of an illumination system for spot illumination is described in U.S. Pat. No. 6,200,002, wherein a tubular collimator collimates light from a light source array arranged in the collimator entrance. Although U.S. Pat. No. 6,200,002 provides for an improved homogeneity compared to previous illumination systems, further improved homogeneity of the emitted light would be desirable.

SUMMARY OF THE INVENTION

In view of the above, a general object of the present invention is to provide an improved illumination system for spot illumination, in particular providing for an improved homogeneity of the light emitted by the illumination system.

According to the invention, there is provided an illumination system for spot illumination, comprising a tubular reflector with a reflective inner surface, the tubular reflector having an entrance aperture, and an exit aperture being larger than the entrance aperture; and a light-source array comprising a plurality of light-sources arranged in a physical light-source configuration to emit light into the tubular reflector at the entrance aperture thereof, wherein the tubular reflector comprises a plurality of reflective surfaces each being arranged to provide a primary mirror image of the light-source array, the primary mirror image having a primary mirror image light-source configuration; and wherein the light-source array is configured in such a way that, for each of the primary mirror images, at least half of all secondary mirror images of the light-source array resulting from reflection of the primary mirror image by the reflective surfaces exhibit secondary mirror image light-source configurations that are different from the physical light-source configuration.

The present invention is based on the realization that an improvement over the prior art in the homogeneity of the light emitted by the illumination system can be achieved by configuring the light-source array in such a way that the number of overlapping mirror images resulting from multiple reflections in the reflective surfaces of the tubular reflector is kept down. In particular, the present inventors have realized that a substantial improvement in the homogeneity of the emitted light can be achieved by configuring the light-source array in such a way that at least one half of the secondary mirror images of the light-source array exhibit a light-source configuration that is different from the physical light-source configuration.

Hereby, the occurrence of preferred directions of the emitted light can be reduced, whereby the homogeneity, that is, the spatial uniformity with respect to intensity and, where applicable, color of the light output by the illumination system can be improved.

By the term "different" should here be understood that the secondary mirror image of the light-source array is not an exact copy of the physical light-source array. In other words, the secondary mirror image light-source configuration is different from the physical light-source configuration when complete overlap with the physical light-source configuration cannot be achieved through a translation only of the secondary mirror image light-source configuration. Accordingly, the secondary mirror image light-source configuration may be in a different rotational state than the physical light-source configuration and/or be scaled differently. In the latter case, although the secondary mirror image light-source configuration may be in the same rotational state as the physical light-source configuration, the distance(s) between the light-sources is/are different, so that a translation operation and a scaling operation would be required to get an exact match between the secondary mirror image of the light-source array and the light-source array.

An additional improvement in the homogeneity of the emitted light can be achieved by configuring the light-source array in such a way that the fraction of secondary mirror images exhibiting secondary mirror image light-source configurations that are different from the physical light-source configuration is further increased to, for example, 75%, the best result being obtained for 100%.

The configuration of the light-source array that yields the desired result will depend on the configuration of the tubular reflector, and it will be straight-forward for those skilled in the art to determine if an illumination system with a given combination of light-source configuration and tubular reflector configuration fulfills the above-mentioned requirement that at least one half of the secondary mirror images of the light-source array exhibit a light-source configuration that is different from the physical light-source configuration.

Advantageously, the different secondary mirror image light-source configurations may be different from the physical light-source configuration at least in respect of a rotational state thereof. Although scaling of the secondary mirror image (a larger or smaller distance between light-sources) will have an advantageous effect on the homogeneity of the emitted light, a more advantageous effect is generally achieved if the secondary mirror image light-source configuration is rotated relative to the physical light-source configuration, since such a rotation will result in a larger number of directions of the light rays emitted by the illumination system.

The reflective surfaces may advantageously be formed by segments that are provided at an angle to each other. In a cross-section of the tubular reflector in a plane that is perpendicular to the optical axis of the illumination system, the segments may be represented by substantially straight lines.

Furthermore, the tubular reflector may be configured in such a way that none of the reflective surfaces is parallel with respect to any other one of the reflective surfaces. Hereby, the number of directions of the light rays emitted by the illumination system can be increased.

Moreover, the tubular reflector may comprise an uneven number of reflective surfaces, whereby the number of directions of the light rays emitted by the illumination system can be increased.

Furthermore, the tubular reflector may have an essentially polygonal cross-section.

By "polygonal cross-section" should, in the context of the present application, be understood a cross-section that is bounded by a closed path of lines connected at at least three points, forming the corners of the polygonal cross-section. The lines can be straight or curved. For example, each path between the corners of the polygon may be concave or convex with respect to the polygonal cross-section. According to one embodiment the polygonal cross section may have an uneven number of sides, for example be septagonal (7 sides) or enneagonal (9 sides).

Regardless of the shape of the tubular reflector, at least one of the reflective surfaces may advantageously be curved. In particular, a section between the at least one reflective surface and a plane that is normal to an optical axis of the illumination system may be a curved line.

Through the latter configuration, scaling of the mirror images can be achieved, whereby the homogeneity of the emitted light can be improved as was described above (larger or smaller distances between the light-sources depending on whether the reflective surfaces are convex or concave).

Moreover, the tubular reflector may be substantially trumpet-shaped, which means that the opening area of the tubular reflector flares out towards the exit aperture with the radius of curvature of the inner surface of the tubular reflector being arranged outside the tubular reflector.

The physical light-source configuration may furthermore be selected such that each rotational symmetry state of the light-source array is different from any rotational symmetry state of the tubular reflector.

By "rotational symmetry state" should, in the context of the present application, be understood a rotational state, different from an initial state, resulting in the same configuration as the initial state.

The tubular reflector may exhibit a first number of rotational states having identical configurations, and the light-source array may exhibit a second number of rotational states having identical configurations, and a ratio between the first number and the second number may be a non-integer. Such a configuration provides for non-coinciding symmetry states.

The number of rotational states having identical configurations equals the initial state plus the number of rotational symmetry states, that is, the number of rotational symmetry states plus one.

By, furthermore, configuring the illumination system in such a way that a largest common divisor of the first number and the second number equals one, the occurrence of preferred directions of the emitted light can be even further reduced, whereby homogeneity of the emitted light can be even further improved.

To further improve the homogeneity of the light emitted by the illumination system, the illumination system may be configured in such a way that the total area of the light-sources comprised in the light-source array may be equal to at least 5% of an area of the entrance aperture of the tubular reflector.

By the total area of the light-sources should be understood the total emissive surface of the light-source, that is, the area that can emit light.

Through the provision of a sufficient ratio between the total emissive area and the area of the entrance aperture, the homogeneity of the light emitted by the illumination system can be improved further. Tests performed by the present inventors have indicated that such a sufficient ratio is around 5% of the area of the entrance aperture of the tubular reflector, and that an even higher ratio yields an even better result. However, the ratio may be preferably equal to or at least 10% more preferably equal to or at least 15%, and most preferably equal to or at least 20%.

According to various embodiments of the present invention, the light-source array may, furthermore, comprise at least one set of light-sources configured to emit light of a first color and at least one set of light-sources configured to emit light of a second color different from the first color.

A set of light-sources may be a single light-source, or may be a group of light-sources arranged together. For example, a set of light-sources may be provided in the form of a line of light-emitting diodes (LEDs).

Hereby, a color controllable output of light from the illumination system can be provided for.

The present inventors have found that configuring the light-source array in such a way that it comprises at least three sets of light-sources configured to emit light of the first color and at least three sets of light-sources configured to emit light of the second color, is beneficial to the homogeneity of the light output by the illumination system.

Moreover, the light-sources may advantageously be arranged in such a way that the largest spacing between adjacent sets of light-sources is smaller than a third of a lateral extension of the entrance aperture. Hereby, large "dark" areas in the light-source array are avoided, which further improves the homogeneity of the light output by the illumination system. Distributing the light-sources even more uniformly in the light-source array results in a further improvement in the homogeneity.

According to various embodiments, the illumination system according to the present invention may advantageously further comprise a light-diffusing optical member arranged to diffuse light emitted by the illumination system, whereby the homogeneity of the light output by the illumination system can be further improved.

In the illumination system according to the various embodiments of the present invention, the light leaving the tubular reflector at the exit aperture thereof is generally better mixed close to the optic axis of the illumination system than it is further away from the optic axis. Therefore, the light-diffusing optical member may advantageously have a diffusing capability that depends on a distance from an optic axis of the illumination system. In particular, the diffusing capability may advantageously increase with increasing distance from the optic axis of the illumination system.

Moreover, the illumination system may advantageously further comprise a focusing optical element arranged to focus light emitted by the illumination system, whereby the angular spread of the light output by the illumination system can be reduced.

Furthermore, the tubular reflector may be shaped in such a way that a substantially gaussian beam profile is achieved at the exit aperture or in the far field.

The length of the tubular reflector may advantageously range from 3 times the diameter of the entrance aperture to 8 times the diameter of the entrance aperture, and the ratio between the diameter of the exit aperture and the diameter of the entrance aperture may advantageously range between 3 and 5.

BRIEF DESCRIPTION OF THE DRAWINGS

These and other aspects of the present invention will now be described in more detail, with reference to the appended drawings showing an exemplary embodiment of the invention, wherein.

DETAILED DESCRIPTION OF AN EMBODIMENT OF THE INVENTION

In the following description, the present invention is described with reference to an illumination system comprising a trumpet-shaped tubular reflector with a polygonal cross-section.

It should be noted that this by no means limits the scope of the invention, which is equally applicable to other illumination systems, in which the tubular reflector is not trumpet-shaped and/or does not have a polygonal cross-section. For example, the tubular reflector may be a straight or parabolic reflector, and/or may have a plurality of reflective surfaces which are not configured in a polygonal fashion.

Figure 1:
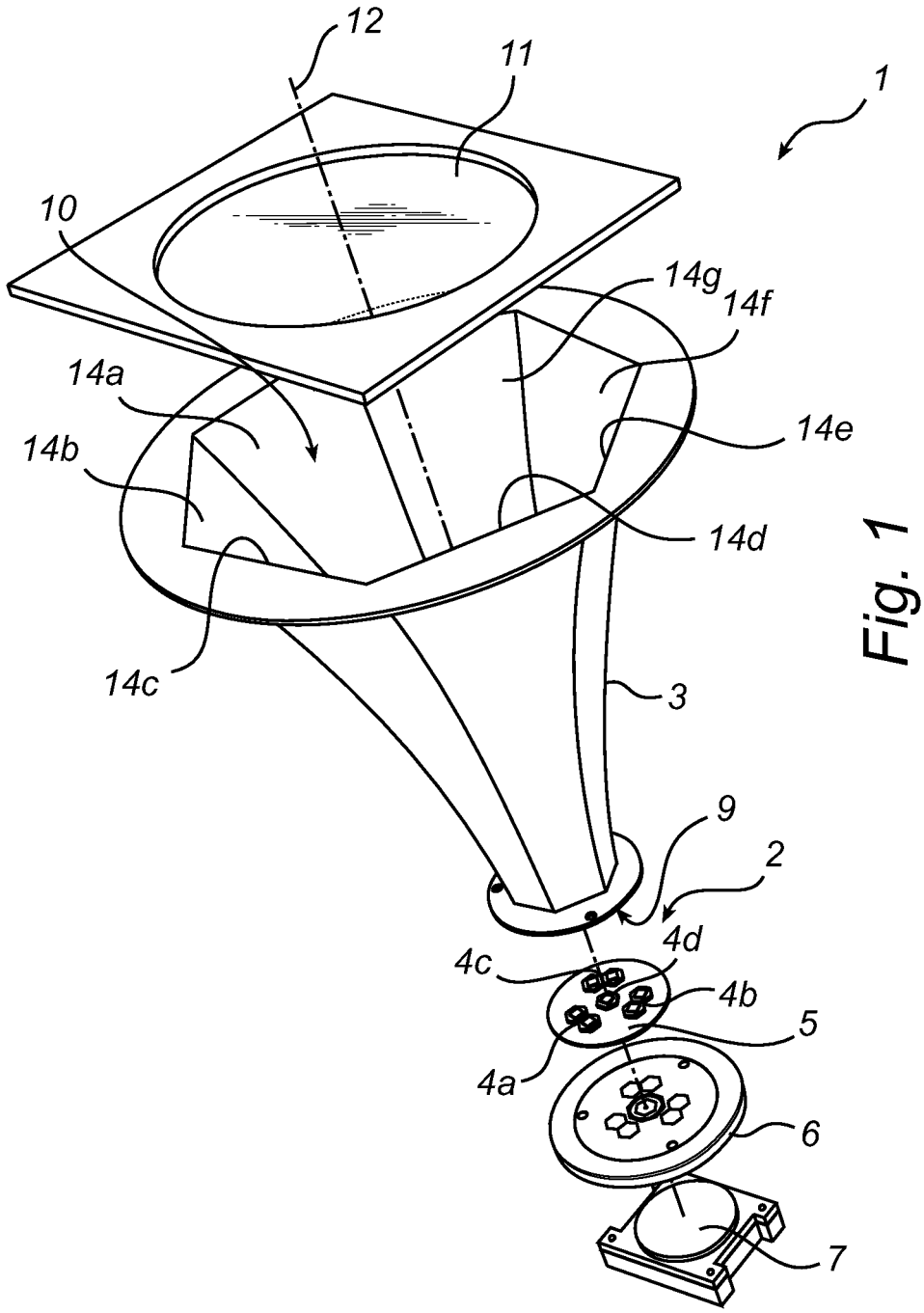
FIG. 1 is an exploded view of an illumination system according to an embodiment of the present invention.

FIG. 1 schematically illustrates an illumination system 1 according to an exemplary embodiment of the present invention. The illumination system 1 comprises a light source array 2 and a tubular reflector 3 with a reflective inner surface. The light-source array 2 comprises a plurality of light sources, such as LED arrays 4*a-d*, mounted on a carrier, such as a printed circuit board (PCB) 5, which is arranged on a heat spreader 6, which is in turn arranged on a heat sink 7. Each LED-array 4*a-d* may comprise one or several LEDs, which may be differently colored. Accordingly, the LED-arrays 4*a-d* may have different properties or substantially the same properties depending on the particular application. The tubular reflector 3 has a light entrance aperture 9, and a light exit aperture 10 being larger than the light entrance aperture 9. At the exit aperture 10 of the tubular reflector 3, a diffusing member, here in the form of an optically diffusing sheet 11 is provided.

The light source array 2 is arranged at the entrance aperture 9, to emit light into the tubular reflector 3. In the exemplary embodiment that is schematically illustrated in FIG. 1, the tubular reflector 3 has a polygonal cross-section in a plane perpendicular to the optical axis 12 of the illumination system 1. Furthermore, the tubular reflector 3 in FIG. 1 has seven reflective surfaces 14*a-g* arranged to reflect the light emitted by the light-sources 4*a-d*.

Although this is not demonstrated explicitly here, all secondary mirror images of the light-source array 2 resulting from reflection of the primary mirror image of the light-source array 2 by the reflective surfaces 14*a-h* exhibit secondary mirror image light-source configurations that are different from the physical light-source configuration. The reason for this is that the secondary mirror image light-source configurations will represent rotation of the light-source array 2 by a rotational angle that is a multiple of (360/7)°. This means that all of the secondary mirror image light-source configurations will be different from the physical light-source configuration, since the rotational symmetry states of the light-source array 2 are rotated by a rotational angle that is a multiple of (360/3)°. Accordingly, the tubular reflector 3 and the light-source array 2 have no coinciding rotational symmetry states.

Some of the terminology used in the present application will now be explained with reference to the schematic cross-section view of a simple illumination system configuration shown in FIG. 2.

Figure 2:
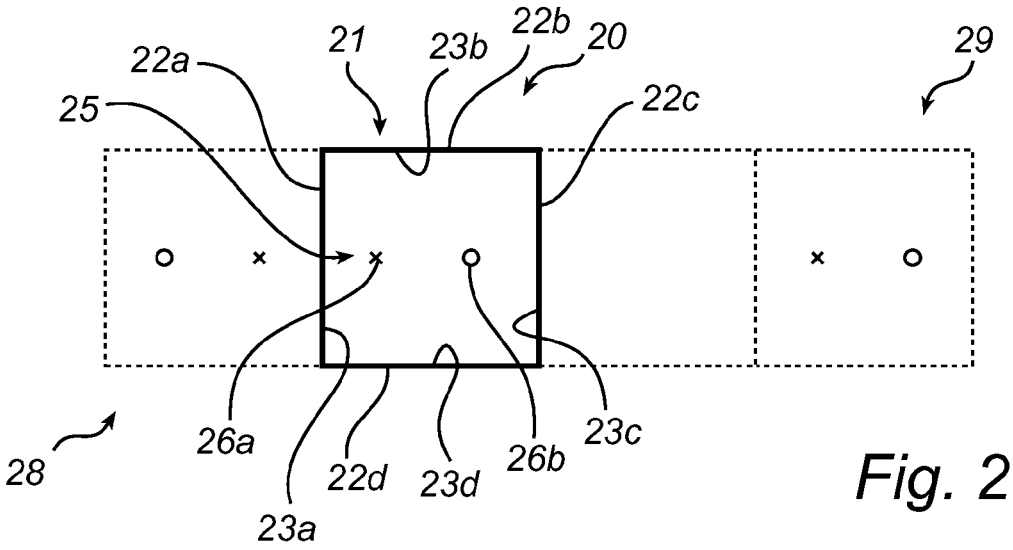
FIG. 2 is a schematic cross-section view of a simple illumination system configuration for the purpose of clarifying the terminology used in the present application.

FIG. 2 is a simplified cross-section representation of an exemplary illumination system 20 seen from the exit aperture towards the entrance aperture of the tubular reflector 21. The tubular reflector 21 has four sides 22*a-d* with inner reflective surfaces 23*a-d*. The illumination system 20 further comprises a simple light-source array 25 having a physical light-source configuration that is schematically illustrated by the "x" and "o" in FIG. 2 representing two different light-sources 26*a-b*.

As is further schematically illustrated in FIG. 2, the light-source array 25 is reflected by the first reflective surface 23*a*, which thus provides a primary mirror image 28 represented by the square to the left in FIG. 2. This primary mirror image 28 has a primary mirror image light-source configuration as illustrated by the "x" and "o" in the square to the left in FIG. 2. As can be seen in FIG. 2, this primary mirror image light-source configuration is different from the physical light-source configuration—if the square to the left in FIG. 2 is translated to overlap with the light-source array 25, the "x" of the primary mirror image light-source configuration will coincide with the "o" of the physical light-source configuration, and the "o" of the primary mirror image light-source configuration will coincide with the "x" of the physical light-source configuration.

When the primary mirror image 28 is reflected by the third reflective surface 23*c*, a secondary mirror image 29 is provided. This secondary mirror image 29 has a secondary mirror image light-source configuration that is represented by the "x" and "o" to the right in FIG. 2. As is clear from FIG. 2, this secondary mirror image light-source configuration is the same as the physical light-source configuration of the light-source array 25.

Although only one representative primary mirror image 28 and one representative secondary mirror image 29 are shown in FIG. 2, it is immediately evident that all the secondary mirror image of the illumination system 20 in FIG. 2 will have a secondary mirror image light-source configuration that is identical to the physical light-source configuration of the light-source array 25. Accordingly, the illumination system in FIG. 2 is not an embodiment of the present invention, but simply an introductory example used to illustrate the concepts of physical light-source configuration, primary mirror image, primary mirror image configuration, secondary mirror image and secondary mirror image configuration which will be used to describe the various exemplary illumination systems that are schematically shown in FIGS. 3*a-c*, FIGS. 4*a-c*, and FIG. 5.

Figure 3A:
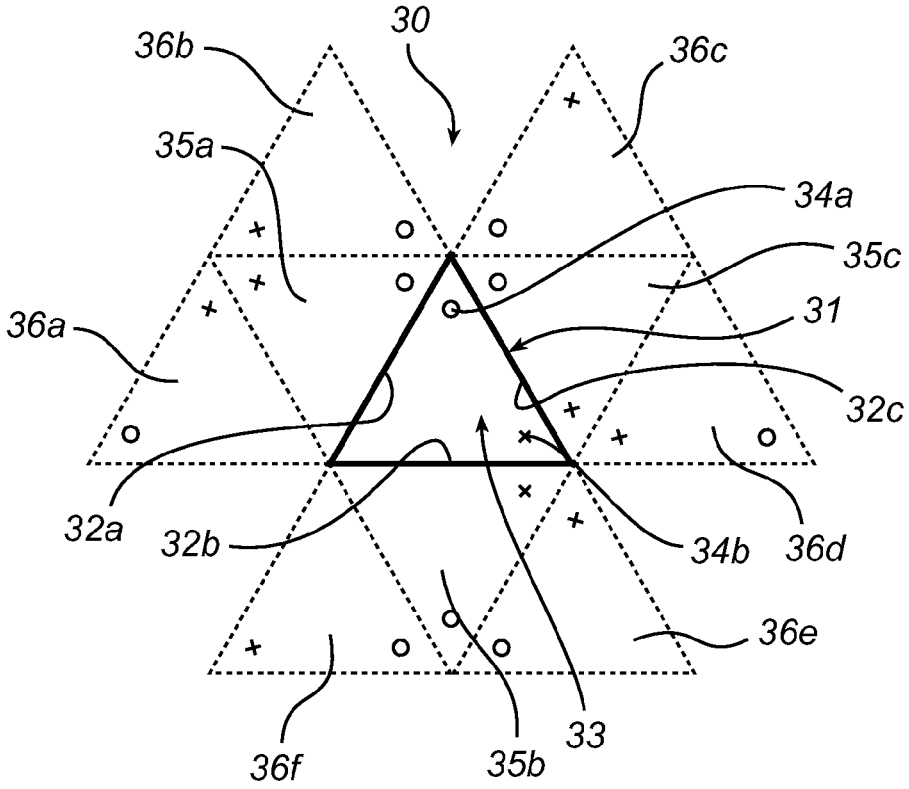
FIGS. 3*a-c* are schematic cross-section views of exemplary illumination systems, where the illumination systems in FIGS. 3*a-b* represent embodiments of the present invention, and the illumination system in FIG. 3*c* is an exemplary system for comparison.
Figure 3B:
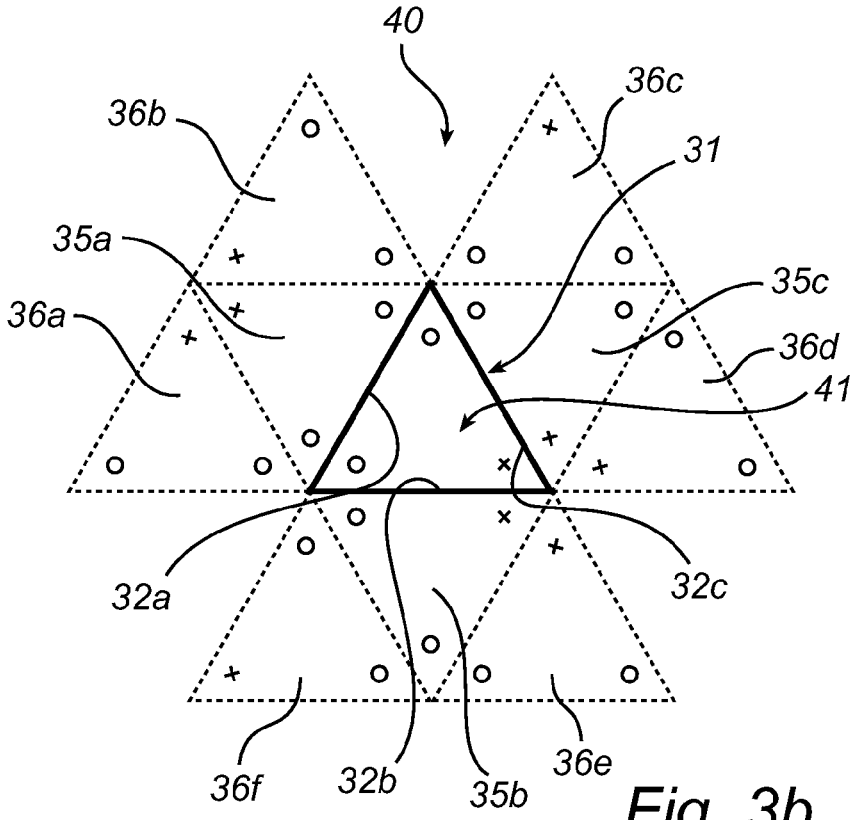
Figure 3C:
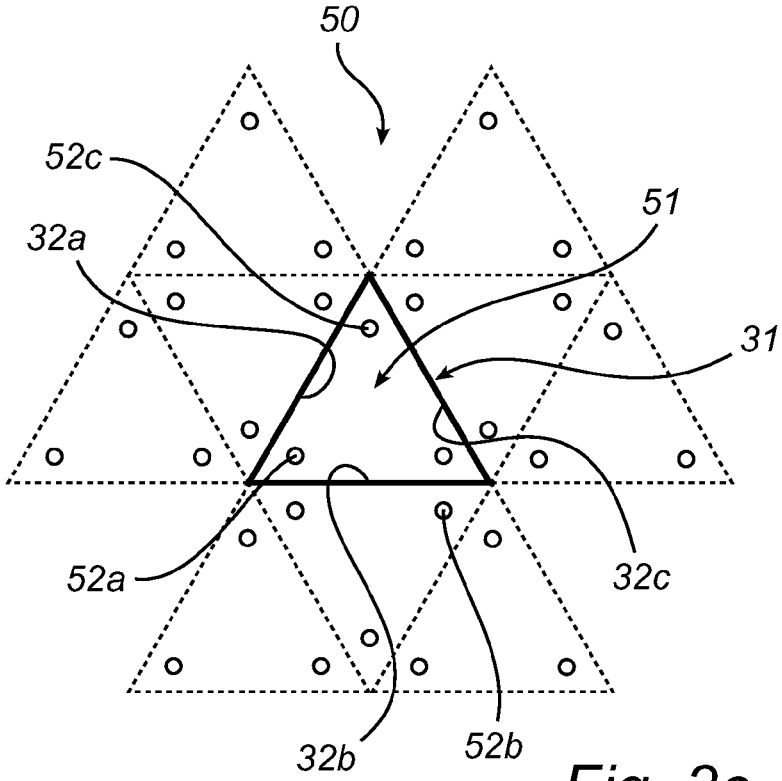

FIGS. 3*a-c* are schematic cross-section views of exemplary illumination systems, where the illumination systems in FIGS. 3*a-b* represent embodiments of the present invention, and the illumination system in FIG. 3*c* is an exemplary system for comparison.

First, an illumination system 30 according to a first embodiment of the present invention will be described with reference to FIG. 3*a*. As can be seen in FIG. 3*a*, the illumination system 30 comprises a tubular reflector 31 with a triangular cross-section, having three inner reflective surfaces 32*a-c*. The illumination system 30 in FIG. 3*a* further comprises a light-source array 33, comprising a plurality of light-sources 34*a-b* arranged in a physical light-source configuration. With the same notation as was introduced above in connection with FIG. 2, the physical light-source configuration is schematically illustrated by "x" and "o" representing the different light-sources 34*a-b*.

As can be seen in FIG. 3*a*, there will be three primary mirror images 35*a-c* with primary mirror image light-source configurations indicated by "x" and "o", and six secondary mirror images 36*a-f* with secondary mirror image light-source configurations indicated by "x" and "o". As is clear from FIG. 3*a*, all secondary mirror image light-source configurations are different from the physical light-source configuration of the light-source array 33. This configuration results in a large number of directions of the emitted light, which provides for an improved homogeneity of the light emitted by the illumination system 30.

Second, an illumination system 40 according to a second embodiment of the present invention will be described with reference to FIG. 3*b*. The illumination system 40 in FIG. 3*b* differs from that in FIG. 3*a* in that the light-source array 41 has a different physical light-source configuration as is schematically shown in FIG. 3*b*.

As is clear from FIG. 3*b*, all secondary mirror image light-source configurations are different from the physical light-source configuration of the light-source array 41. This configuration results in a large number of directions of the emitted light, which provides for an improved homogeneity of the light emitted by the illumination system 40.

Third, an exemplary illumination system 50 for comparison will be briefly described with reference to FIG. 3*c*. The illumination system 50 in FIG. 3*c* differs from the illumination systems 30, 40 in FIGS. 3*a-b* in that the light-source array 51 has a physical light-source configuration with three identical light-sources 52*a-c* that are symmetrically arranged as shown in FIG. 3*c*. It is immediately clear from FIG. 3*c* that all secondary mirror image light-source configurations are identical to the physical light-source configuration of the light-source array 51. As a consequence, the light emitted by the illumination system 50 in FIG. 3*c* will exhibit a lower degree of homogeneity than the light emitted by the illumination systems 30, 40 in FIGS. 3*a-b*.

Figure 4A:
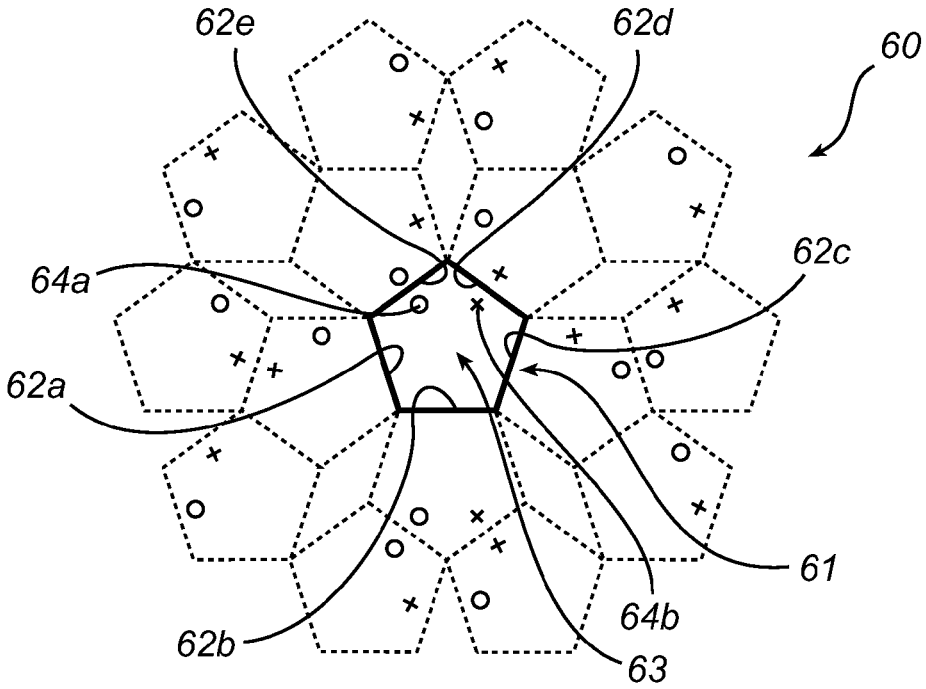
FIGS. 4*a-c* are schematic cross-section views of exemplary illumination systems, where the illumination systems in FIGS. 4*a-b* represent embodiments of the present invention, and the illumination system in FIG. 4*c* is an exemplary system for comparison.
Figure 4B:
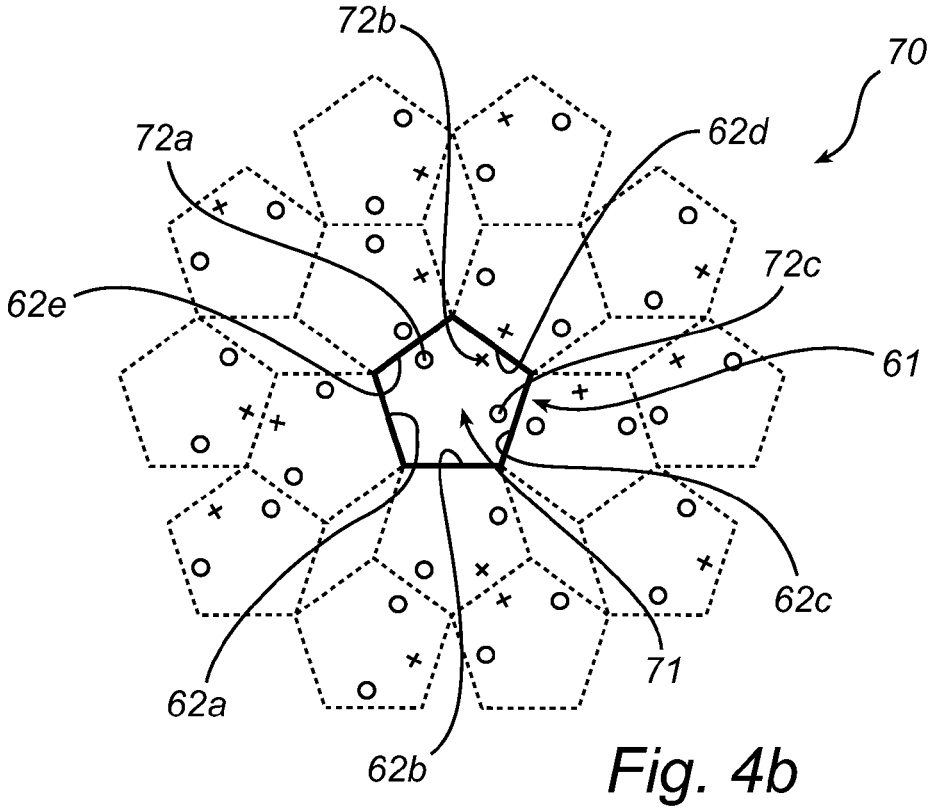
Figure 4C:
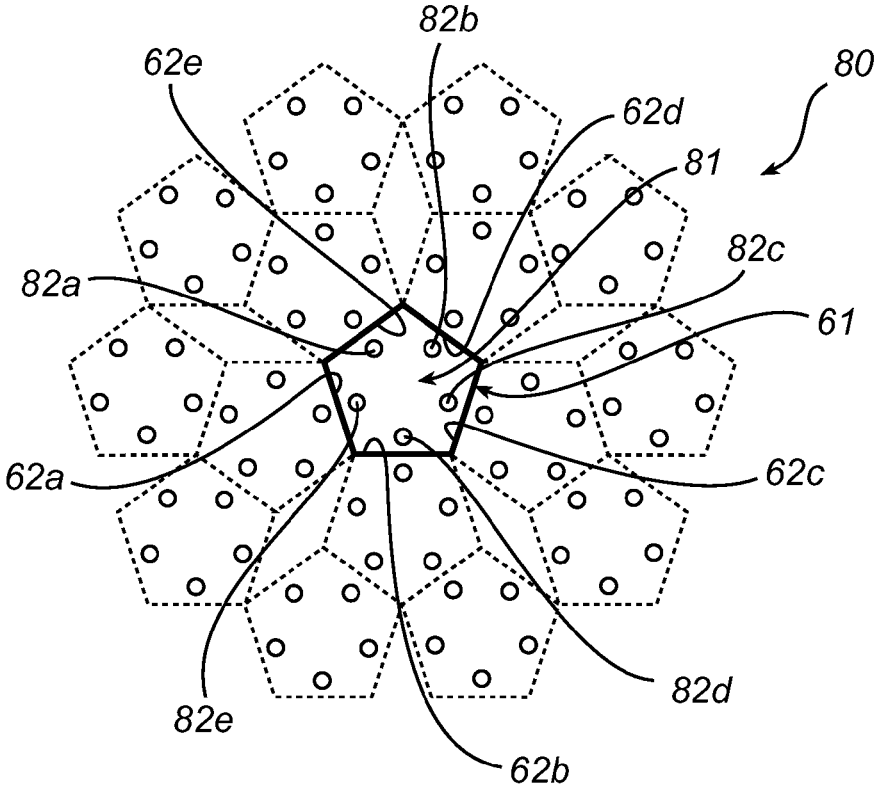

FIGS. 4*a-c* are schematic cross-section views of exemplary illumination systems, where the illumination systems in FIGS. 4*a-b* represent embodiments of the present invention, and the illumination system in FIG. 4*c* is an exemplary system for comparison.

The illumination system 60 in FIG. 4*a* comprises a tubular reflector 61 having a pentagonal cross-section with five reflective surfaces 62*a-e*. The illumination system 60 in FIG. 4*a* further comprises a light-source array 63 comprising two light-sources 64*a-b* arranged in a physical light-source configuration as is schematically indicated in FIG. 4*a* using the same notation as was used above in connection with FIGS. 3*a-c*.

As is clear from FIG. 4*a*, all secondary mirror image light-source configurations are different from the physical light-source configuration of the light-source array 63. This configuration results in a large number of directions of the emitted light, which provides for an improved homogeneity of the light emitted by the illumination system 60.

FIG. 4*b* schematically shows another exemplary illumination system 70 according to an embodiment of the present invention, which differs from that described above in connection with FIG. 4*a* in that the light-source array 71 comprises three light-sources 72*a-c* that are arranged in a different physical light-source configuration.

As is clear from FIG. 4*b*, all secondary mirror image light-source configurations are different from the physical light-source configuration of the light-source array 71. This configuration results in a large number of directions of the emitted light, which provides for an improved homogeneity of the light emitted by the illumination system 70.

Turning now to FIG. 4*c*, the illumination system 80 schematically illustrated there differs from the illumination systems 60, 70 in FIGS. 4*a-b* in that the light-source array 81 has a physical light-source configuration with five identical light-sources 82*a-e* that are symmetrically arranged as shown in FIG. 4*c*. It is immediately clear from FIG. 4*c* that all secondary mirror image light-source configurations are identical to the physical light-source configuration of the light-source array 81. As a consequence, the light emitted by the illumination system 80 in FIG. 4*c* will exhibit a lower degree of homogeneity than the light emitted by the illumination systems 60, 70 in FIGS. 4*a-b*.

In the exemplary illumination systems described so far, all the secondary mirror image light-source configurations have either been different from the physical light-source configuration, or identical to the physical light-source configuration. It should be noted, however, that the present invention is not limited to illumination systems in which the light-source array is configured in such a way that all the secondary mirror image light-source configurations are different from the physical light-source configuration. Below, with reference to FIG. 5, an illumination system according to a further embodiment of the present invention will be described, where a fraction of the secondary mirror images exhibit secondary mirror image light-source configurations that are not different from the physical light-source configuration.

Figure 5:
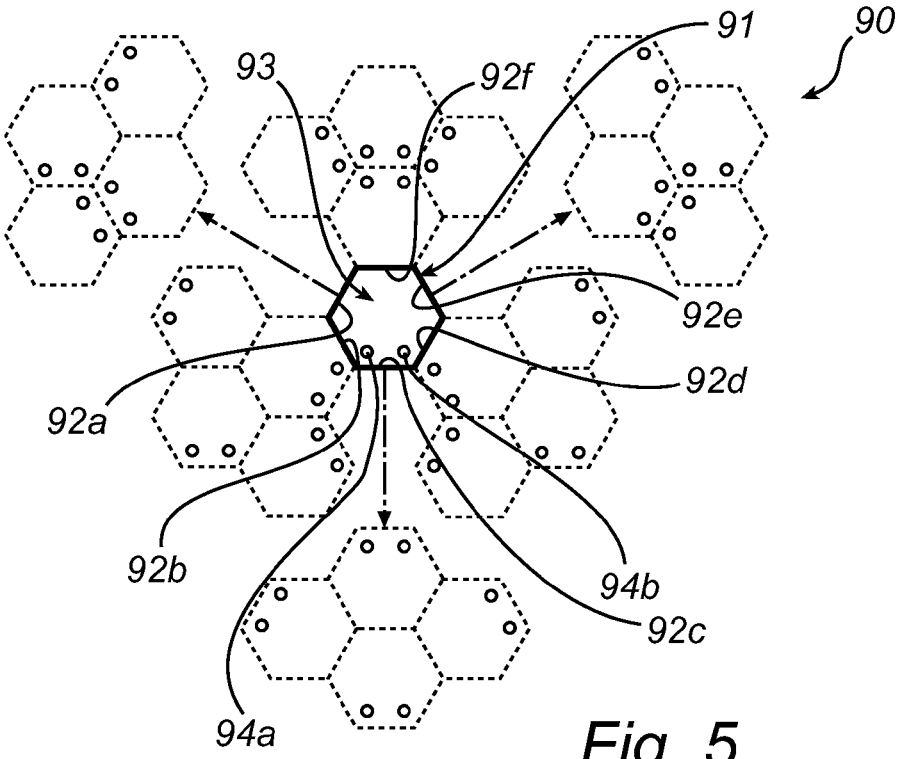
FIG. 5 is a schematic cross-section views of an exemplary illumination system according to another embodiment of the present invention.

The illumination system 90 in FIG. 5 comprises a tubular reflector 91 having a hexagonal cross-section with six reflective surfaces 92*a-f*. The illumination system 90 in FIG. 5 further comprises a light-source array 93 comprising two identical light-sources 94*a-b* arranged in a physical light-source configuration as is schematically indicated in FIG. 5 using the same notation as was used above in connection with FIGS. 3*a-c*.

As is clear from FIG. 5, two thirds of all secondary mirror image light-source configurations are different from the physical light-source configuration of the light-source array 93. This configuration results in a large number of directions of the emitted light, which provides for an improved homogeneity of the light emitted by the illumination system 90.

The various light-sources illustrated by "x" and "o" in the figures may advantageously be LEDs or LED-arrays. Furthermore, the differently colored LEDs may emit various colors, such as red, green, blue, amber, cyan, deep red and/or deep blue etc. Alternatively or additionally, various white light-sources may be used, such as warm white, neutral white and/or cool white.

Additionally, variations to the disclosed embodiments can be understood and effected by the skilled person in practicing the claimed invention, from a study of the drawings, the disclosure, and the appended claims. For example, various other light-source configurations are feasible. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage.

The invention claimed is:

1. An illumination system for spot illumination comprising:

a tubular reflector with a reflective inner surface, said tubular reflector having an entrance aperture, and an exit aperture being larger than the entrance aperture; and a light-source array comprising a plurality of light-sources arranged in a physical light-source configuration to emit light into the tubular reflector at the entrance aperture thereof, wherein said tubular reflector comprises an uneven number of reflective surfaces each being arranged to provide a primary mirror image of said light-source array, said primary mirror image having a primary mirror image light-source configuration; and wherein said light-source array is configured in such a way that, for each of said primary mirror images, at least half of all secondary mirror images of said light-source array resulting from reflection of said primary mirror image by said reflective surfaces exhibit secondary mirror image light-source configurations that are different from said physical light-source configuration.

2. The illumination system according to claim 1, wherein said different secondary mirror image light-source configurations are different from said physical light-source configuration at least in respect of a rotational state thereof.

3. The illumination system according to claim 1, wherein said tubular reflector is configured in such a way that none of said reflective surfaces is parallel with respect to any other one of said reflective surfaces.

4. The illumination system according to claim 1, wherein said tubular reflector has an essentially polygonal cross-section.

5. The illumination system according to claim 1, wherein at least one of said reflective surfaces is curved.

6. The illumination system according to claim 1, wherein a section between said at least one reflective surface and a plane that is normal to an optical axis of said illumination system is a curved line.

7. The illumination system according to claim 1, wherein said tubular reflector is substantially trumpet-shaped.

8. The illumination system according to claim 1, wherein said physical light-source configuration is selected such that each rotational symmetry state of said light-source array is different from any rotational symmetry state of said tubular reflector.

9. The illumination system according to claim 8, wherein said tubular reflector exhibits a first number of rotational symmetry states having identical configurations, and said light-source array exhibits a second number of rotational symmetry states having identical configurations, a ratio between said first number and said second number being a non-integer.

10. The illumination system according to claim 1, wherein a total area occupied by the light-sources comprised in said light-source array is equal to at least 5% of an area of said entrance aperture.

11. The illumination system according to claim 1, wherein said light-source array comprises at least one set of light-sources configured to emit light of a first color and at least one set of light-sources configured to emit light of a second color different from the first color.

12. The illumination system according to claim 11, wherein said light-source array comprises at least three sets of light-sources configured to emit light of said first color and at least three sets of light-sources configured to emit light of said second color; and wherein a largest spacing between neighboring ones of said sets of light-sources is smaller than a third of a lateral extension of said entrance aperture.

13. The illumination system according to claim 1, further comprising a light-diffusing optical member arranged to diffuse light output by said illumination system.

14. The illumination system according to claim 1, further comprising a focusing optical element arranged to focus light output by said illumination system.

* * * * *